US006043441A

United States Patent [19]

Hashida

[11] Patent Number: 6,043,441

[45] Date of Patent: Mar. 28, 2000

[54] MEMBRANE SWITCH DEVICE CAPABLE OF ENSURING BONDING AROUND MOUNTING HOLES

[75] Inventor: Junji Hashida, Miyagi-ken, Japan

[73] Assignee: Alps Electric Co., Ltd., Japan

[21] Appl. No.: 09/395,458

[22] Filed: Sep. 14, 1999

[30] Foreign Application Priority Data

Sep. 17, 1998 [JP] Japan ..... 10-263334

[51] Int. Cl.[7] ..... H01H 13/70

[52] U.S. Cl. ..... 200/512

[58] Field of Search ..... 200/5 A, 512–517

[56] References Cited

U.S. PATENT DOCUMENTS

| | | | |
|---|---|---|---|
| 4,289,940 | 9/1981 | Sado et al. | 200/5 A |
| 4,433,223 | 2/1984 | Larson et al. | 200/159 B |
| 4,489,227 | 12/1984 | Lamarche | 200/314 |
| 4,558,190 | 12/1985 | Saito | 200/5 A |
| 4,694,126 | 9/1987 | Aiken, Jr. et al. | 200/5 A |
| 5,401,922 | 3/1995 | Asta | 200/5 A |

FOREIGN PATENT DOCUMENTS 1-227316 9/1989 Japan ..... H01H 13/70

*Primary Examiner*—Michael Friedhofer
*Attorney, Agent, or Firm*—Brinks Hofer Gilson & Lione

[57] ABSTRACT

A membrane switch is disclosed which comprises an upper sheet, a lower sheet disposed in an opposed relation to the upper sheet, and an insulating resist layer for pasting both upper and lower sheets with each other. The upper and lower sheets are respectively formed with plural contact portions and plural mounting holes in such a manner that the contact portions formed on the upper sheet side and the contact portions formed on the lower sheet side are opposed to each other and so are the mounting holes. The insulating resist layer comprises a first insulating resist layer formed on at least one of the upper and lower sheets except the portions where the contact portions are positioned and a second insulating resist layer formed on the first insulating resist layer at each of positions near the mounting holes so as to surround the whole circumference of each mounting hole. The insulating resist layer in the area where the second resist layer is formed is made thicker than in the other area.

4 Claims, 6 Drawing Sheets

MEMBRANE SWITCH DEVICE CAPABLE OF ENSURING BONDING AROUND MOUNTING HOLES

BACKGROUND OF THE INVENTION

1. Field of the Invention

The present invention relates to a membrane switch for use in a keyboard device or the like.

2. Description of the Related Art

A conventional membrane switch will now be described with reference to FIGS. 9 to 12. As shown in FIG. 11, filmy upper sheet 21 and lower sheet 22 each made of an insulating material are formed integrally with each other through a connecting portion 23 and can be folded in two at the connecting portion 23.

The upper sheet 21 has a plurality of mounting holes 21*a* and the lower sheet 22 also has a plurality of mounting holes 22*a* formed in an opposed relation to the mounting holes 21*a*.

The upper sheet 21 is formed with a plurality of contact portions 24 using silver paste or the like and the lower sheet 22 is also formed with a plurality of contact portions 25 using silver paste or the like in an opposed relation to the contact portions 24. Each of the contact portions 24 and 25 is connected to each of connecting conductors 26 formed of silver paste or the like.

Further, the lower sheet 22 is formed with lead-out terminals 27 using silver paste or the like, with the connecting conductors 26 being connected to the lead-out terminals 27.

An insulating resist layer 28 is formed on the surface of the lower sheet 22 except the contact portions 25 and the lead-out terminals 27, as shown in FIG. 12.

In the insulating resist layer 28, one layer of insulating paste which contains a thermoplastic resin as a main component is formed on the surface of the lower sheet 22 by printing and the connecting portion 23 is folded, allowing the upper sheet 21 to be superimposed on the insulating resist layer 28. Thereafter, the upper and lower sheets 21, 22 are pressed vertically against each other under heating, with the result that both sheets are pasted together by the insulating resist layer 28.

In this laminated state, as shown in FIG. 9, the insulating resist layer 28 functions as a spacer so that the contact portions 24 and 25 are spaced from and opposed to each other and so that the mounting holes 21*a* and 22*a* are also opposed to each other.

A lower support member 29 is formed, for example, by a synthetic resin or metal plate and it has a plurality of holes 29*a*. The lower sheet 22 is put on the support member 29 in such a manner that the mounting holes 21*a* and 22*a* are opposed to the holes 29*a*.

A plate-like upper support member 30 is formed, for example, by molding a synthetic resin. The upper support member 30 has holes 30*a* formed oppsite to the contact portions 24 of the upper sheet 21 and also has columnar mounting portions 30*b* formed in an opposed relation to the holes 29*a*. The support member 30 is put on the upper sheet 21 with its mounting portions 30*b* inserted into the holes 29*a*, and end portions of the mounting portions 30*b* are pressure-deformed to unite the support member 29, lower sheet 22, upper sheet 21, and support member 30, thereby constituting a membrane switch.

The above membrane switch is attached, for example, to the case of a keyboard device so that the upper support member 30 is exposed to the surface of the case.

The membrane switch is operated in the following manner. The upper sheet 21 is depressed and deformed through the holes 30*a* of the support member 30, causing the contact portions 24 to come into contact with the contact portions 25 to switch ON. Further, the depressed and deformed state is released, allowing the contact portions 24 and 25 to be spaced from each other to switch OFF.

There also is known such a membrane switch as shown in FIG. 13, in which the support member 30 used in the above membrane switch is omitted for attaining the reduction in thickness, a support portion 29*c* of a lower support member 29 is projected to the upper surface side through holes 31 of upper and lower sheets 21, 22, an X-shaped leg portion 33 with a key top 32 attached thereto is secured to the support portion 29*c*, an operating portion 34 formed of a rubber material is disposed between the key top 32 and the upper sheet 21, and by depressing the key top 32 the membrane switch is operated through the operating portion 34.

In the conventional membrane switches described above, the insulating resist layer 28 formed as a single layer on the lower sheet 22 cannot be made uniform in thickness throughout the whole surface thereof, that is, the thickness thereof is non-uniform, so it is necessary to increase the pressing force against both upper and lower sheets 21, 22 for pasting the two together.

Further, even if the pressing force is increased, the laminated state is unsatisfactory at a thin portion of the insulating resist layer 28, which results in water soaking into the contact portions 24 and 25 through the unsatisfactory laminated portion from the mounting holes 21*a* and 22*a* which are exposed from the surface of the case, thus causing defective insulation, or water soaking into the contact portions 24 and 25 through the unsatisfactory laminated portion from the peripheral edge portions of the upper and lower sheets 21, 22, thus causing defective insulation.

Particularly, if the spacing between the contact portions 24, 25 and the mounting holes 21*a*, 22*a* is narrow, defective insulation is apt to occur in such a narrow portion.

The above conventional membrane switch has the problem that the insulating resist layer 28 formed as a single layer on the lower sheet 22 cannot be made uniform in thickness throughout the whole surface thereof and due to such a non-uniform thickness it is required to increase the pressing force against the upper and lower sheets 21, 22 for pasting the two together, thus resulting in increased elongation of both sheets.

Moreover, even if the pressing force is increased, the laminated state is unsatisfactory at a thin portion of the insulating resist layer 28, with the result that water soaks into the contact portions 24 and 25 from the mounting holes 21*a* and 22*a* which are exposed from the case surface, causing defective insulation, or water soaks into the contact portions 24 and 25 from the peripheral edge portions of the upper and lower sheets 21, 22, causing defective insulation. This is also a problem that is encountered in the conventional membrane switch.

SUMMARY OF THE INVENTION

According to a first embodiment of the present invention for solving the above-mentioned problems there is provided a membrane switch device comprising an insulating upper sheet, an insulating lower sheet disposed in an opposed relation to the upper sheet, a plurality of contact portions formed on each of the upper and lower sheets in such a manner that the contact portions formed on the upper sheet and the contact portions formed on the lower sheet are opposed to each other, and a plurality of mounting holes formed in each of the upper and lower sheets in such a manner that the mounting holes formed in the upper sheet and the mounting holes formed in the lower sheet are opposed to each other, wherein a first insulating resist layer is formed on at least one of the upper and lower sheets except the portions where the contact portions are positioned, a second insulating resist layer is formed on the first insulating resist layer at each of positions near the mounting holes so as to surround the whole circumference of each of the mounting holes, and the upper and lower sheets are pasted together by the first and second insulating resist layers.

According to a second embodiment of the invention for solving the foregoing problems, the second insulating resist layer is formed on the first insulating resist layer positioned along the peripheral edge of either the upper sheet or the lower sheet, and the peripheral edge portions of the upper and lower sheets are pasted together by the second insulating resist layer.

According to a third embodiment of the invention for solving the foregoing problems, the second insulating resist layer is formed on the first insulating resist layer at each of positions near the aforesaid contact portions, and the upper and lower sheets are pasted together in the vicinity of the contact portions by the second insulating resist layer.

According to a fourth embodiment of the invention for solving the foregoing problems there is provided a membrane switch device comprising an insulating upper sheet, an insulating lower sheet disposed in an opposed relation to the upper sheet, and a plurality of contact portions formed on each of the upper and lower sheets in such a manner that the contact portions formed on the upper sheet and the contact portions formed on the lower sheet are opposed to each other, wherein a first insulating resist layer is formed on at least one of the upper and lower sheets except the portions where the contact portions are positioned, a second insulating resist layer is formed on the first insulating resist layer at each of positions near the contact portions so as to surround each of the contact portions, and the upper and lower sheets are pasted together by the first and second insulating resist layers.

DETAILED DESCRIPTION OF PREFERRED MODES OF EMBODIMENT

Figure 1:
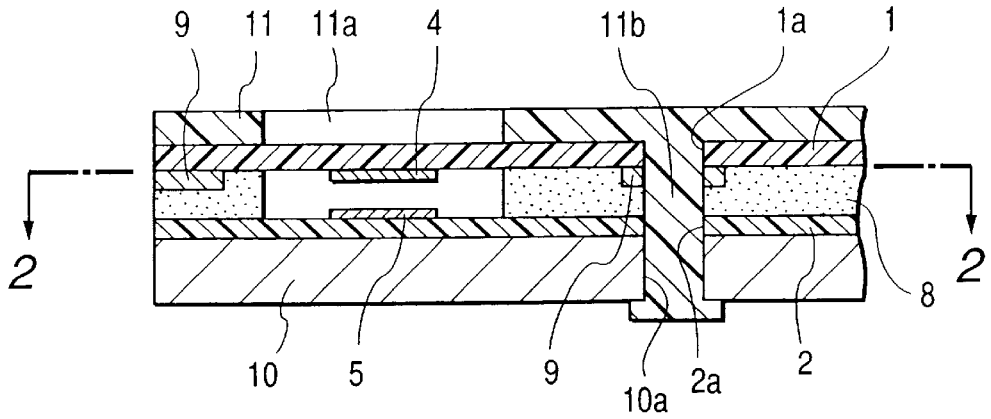
FIG. 1 is an enlarged sectional view of a principal portion of a membrane switch according to the first mode of embodiment of the present invention.
Figure 2:
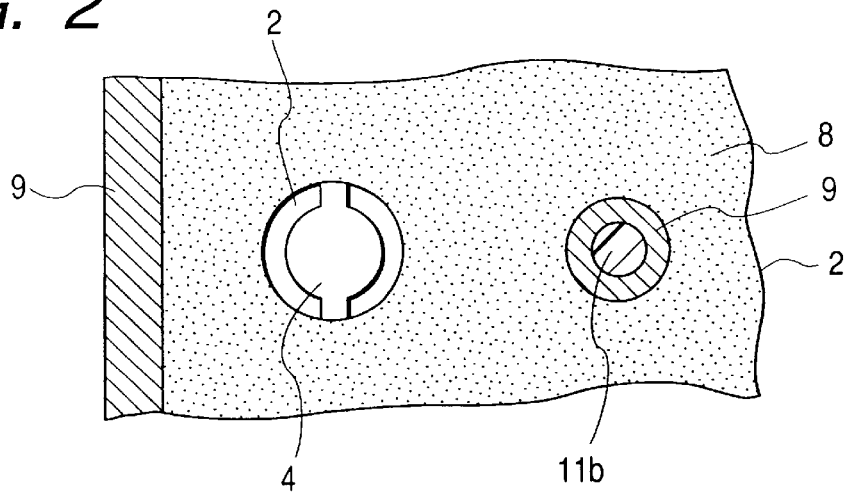
FIG. 2 is a sectional view taken on line 2—2 in FIG. 1.
Figure 3:
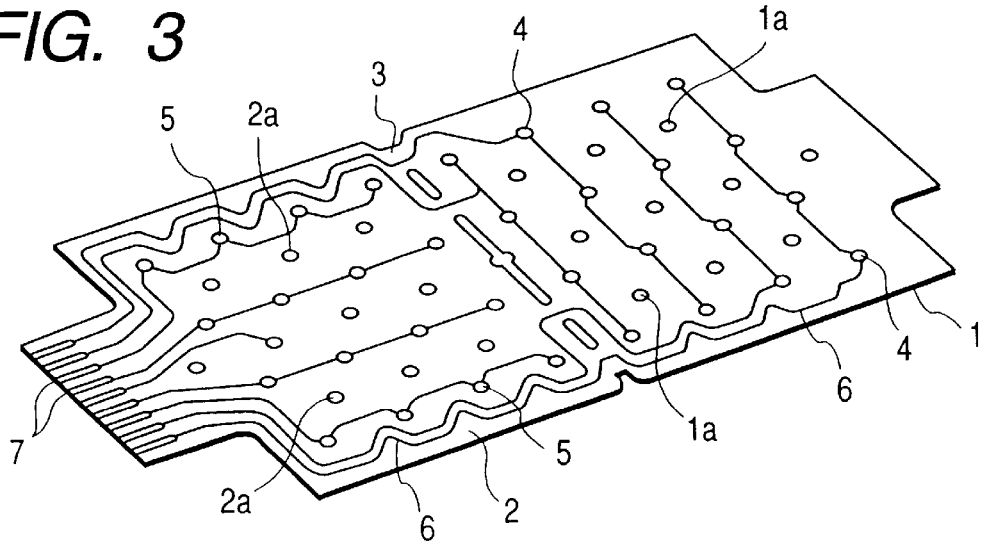
FIG. 3 is a perspective view of an upper sheet and a lower sheet both used in the membrane switch of the first mode of embodiment.
Figure 4:
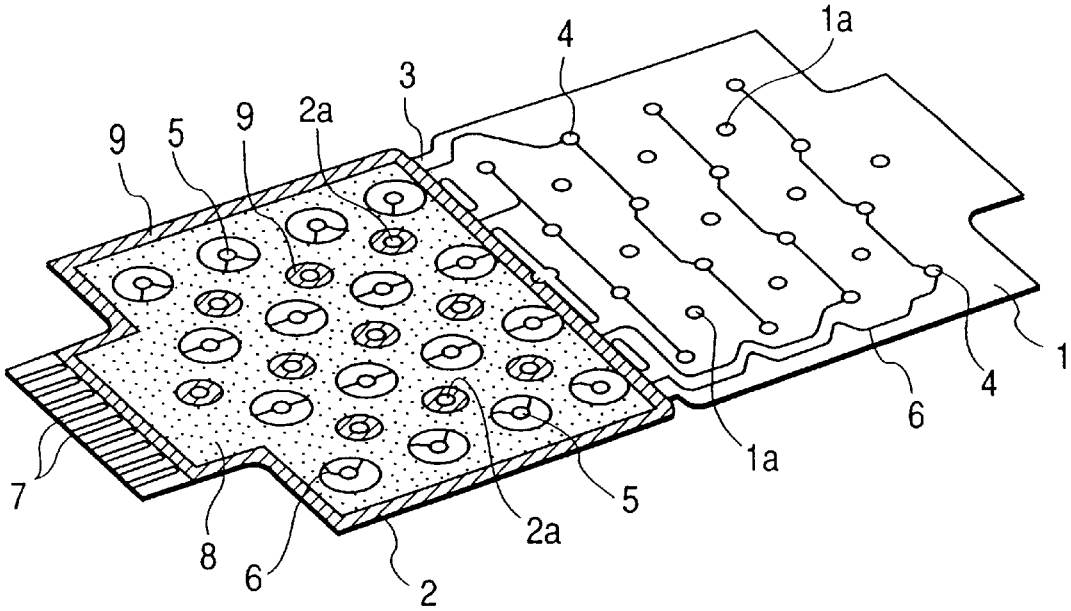
FIG. 4 is a perspective view of the membrane switch of the first mode of embodiment, with an insulating resist layer formed on the lower sheet.

A membrane switch according to the first mode of embodiment of the present invention will now be described with reference to FIGS. 1 to 4, of which FIG. 1 is an enlarged sectional view of a principal portion of the membrane switch, FIG. 2 is a sectional view taken on line 2—2 in FIG. 1, FIG. 3 is a perspective view of an upper sheet and a lower sheet both used in the membrane switch, and FIG. 4 is a perspective view of both upper and lower sheets, with an insulating resist layer formed on the lower sheet.

As shown in FIG. 3, a filmy upper sheet 1 and a filmy lower sheet 2, each made of an insulating material, are formed integrally with each other through a connecting portion 3 and can be folded in two at the connecting portion.

The upper sheet 1 has a plurality of mounting holes 1*a* and the lower sheet 2 has a plurality of mounting holes 2*a* in an opposed relation to the mounting holes 1*a*.

The upper sheet 1 is formed with a plurality of contact portions 4 using silver paste or the like and the lower sheet 2 is also formed with a plurality of contact portions 5 using silver paste or the like. Each of the contact portions 4 and 5 is connected to each of connecting conductors 6 formed of silver paste or the like.

The lower sheet 2 is formed with lead-out terminals 7 using silver paste or the like, with the connecting conductors 6 being connected to the lead-out terminals 7.

As shown in FIG. 4, a first insulating resist layer 8 is formed on the surface of the lower sheet 2 exclusive of the contact portions 5 and the lead-out terminals 7. More specifically, as the first insulating resist layer 8, an insulating paste containing a thermoplastic resin as a main component is formed by printing on the surface of the lower sheet 2.

A second insulating resist layer 9, as shown in FIG. 4, is formed on the first insulating resist layer 8 at each of positions near the mounting holes 2*a* so as to surround the whole circumference of each mounting hole 2*a*, and it is formed on the first insulating resist layer 8 along the peripheral edge portion of the lower sheet 2. Thus, the portion where the second insulating resist layer 9 is formed is a two-layer portion larger in thickness than the other portion.

As the second insulating resist layer 9, like the first insulating resist layer 8, an insulating paste containing a thermoplastic resin as a main component, is formed on the first insulating resist layer by printing.

Although the first and second insulating resist layers 8 and 9 are thus formed on the lower sheet 2, they may be formed on the upper sheet 1.

The connecting portion 3 is folded to put the upper sheet 1 on the insulating resist layers 8 and 9 and subsequently the upper and lower sheets 1, 2 are pressed vertically against each other under heating, with the result that both sheets are pasted together by the insulating resist layers 8 and 9.

In this case, at the two-layer portions where both first and second insulating resist layers 8 and 9 are formed, because of a larger thickness, the pressing force is sure to be transmitted to the upper and lower sheets 1, 2, which therefore can be pasted together to a satisfactory extent. Once both sheets are thus pasted together, as shown in FIG. 1, the insulating resist layers 8 and 9 function as a spacer, through which the contact portions 4 and 5 are spaced from and opposed to each other and the mounting holes 1*a* and 2*a* also become opposed to each other.

A lower support member 10 formed, for example, by a synthetic resin or metal plate has a plurality of holes 10*a*, and the lower sheet 2 is put on the lower support member 10 in such a manner that the mounting holes 1*a* and 2*a* are opposed to the holes 10*a*.

A plate-like upper support member 11 formed, for example, by molding a synthetic resin has holes 11*a* formed in positions opposed to the contact portions 4 of the upper sheet 1 and also has columnar mounting portions 11*b* formed in an opposed relation to the holes 10*a*. The support member 11 is placed on the upper sheet 1 while inserting its mounting portions 11*b* into the holes 10*a*. Then, end portions of the mounting portions 11*b* are pressed and deformed, whereby the lower support member 10, lower sheet 2, upper sheet 1 and upper support member 11 are united to constitute a membrane switch.

The membrane switch thus constituted is attached, for example, to the case of a keyboard device so that the upper support member 11 is exposed to the surface of the case.

The membrane switch is operated in the following manner. The upper sheet is depressed and deformed through a hole 11*a* of the support member 11 with use of a finger or a key, causing the associated contact portion 4 to come into contact with the contact portion 5 opposed thereto to switch ON, while the depressed and deformed state is released, thus allowing the contact portions 4 and 5 to become spaced from each other to switch OFF.

Figure 5:
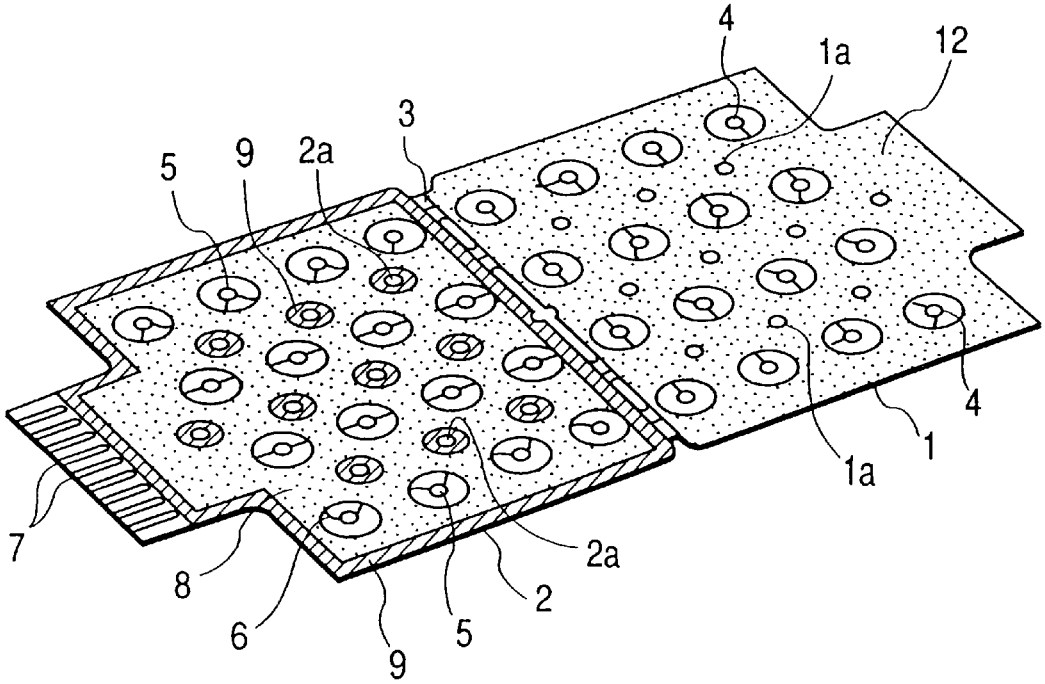
FIG. 5 is a perspective view of the membrane switch of the second mode of embodiment, with insulating resist layers formed respectively on the upper and lower sheets.

Referring now to FIG. 5, there is illustrated a membrane switch according to the second mode of embodiment of the present invention, in which a third insulating resist layer 12 is formed on the surface of an upper sheet 1 exclusive of contact portions 4 to further ensure bonding of the upper sheet to first and second insulating resist layers 8, 9.

Figure 6:
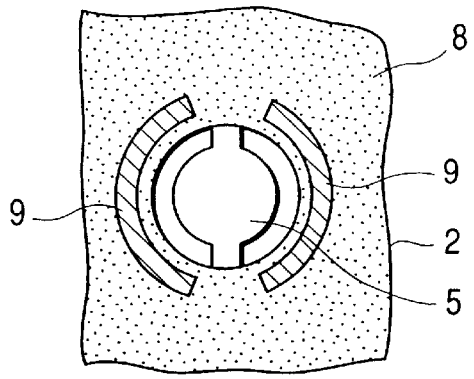
FIG. 6 is a sectional view of a principal portion of a membrane switch according to the third mode of embodiment of the present invention.

Referring now to FIG. 6, there is illustrated a membrane switch according to third mode of embodiment of the present invention, in which a second insulating resist layer 9 is formed on a first insulating resist layer 8 at each of positions near contact portions 5 to ensure bonding in the vicinity of each contact portion 4 of an upper sheet 1, thereby preventing floating of the upper sheet 1 and ensuring the switch operation.

Figure 7:
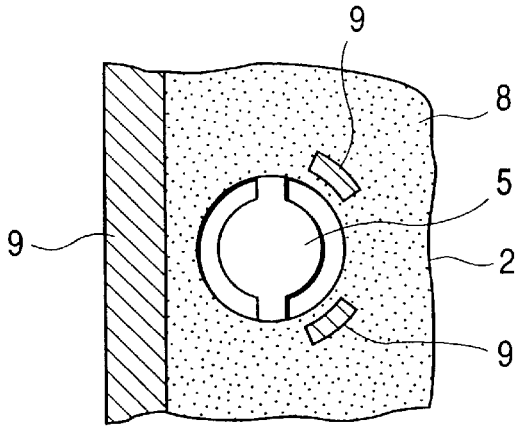
FIG. 7 is a sectional view of a principal portion of a membrane switch according to the fourth mode of embodiment of the present invention.

Referring now to FIG. 7, there is illustrated a membrane switch according to the fourth mode of embodiment of the present invention, in which a second insulating resist layer 9 is formed on a first insulating resist layer 8 at each of positions near contact portions 5 and, in cooperation with a second insulating resist layer 9 formed on the peripheral edge portion of a lower sheet 2, ensures bonding in the vicinity of each contact portion 4 of an upper sheet 1, thereby preventing floating of the upper sheet 1 and ensuring the switch operation.

In the second, third and fourth modes of embodiment illustrated in FIGS. 5, 6, and 7, respectively, other constructional points are the same as in the first mode of embodiment. Although in each of these modes of embodiment the first and second insulating resist layers 8, 9 are formed on the lower sheet 2, they may be formed on the upper sheet 1.

Figure 8:
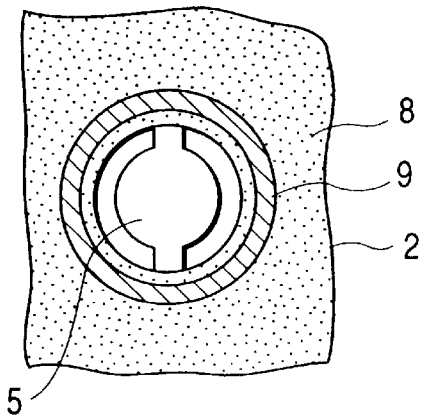
FIG. 8 is a sectional view of a principal portion of a membrane switch according to the fifth mode of embodiment of the present invention.
Figure 9:
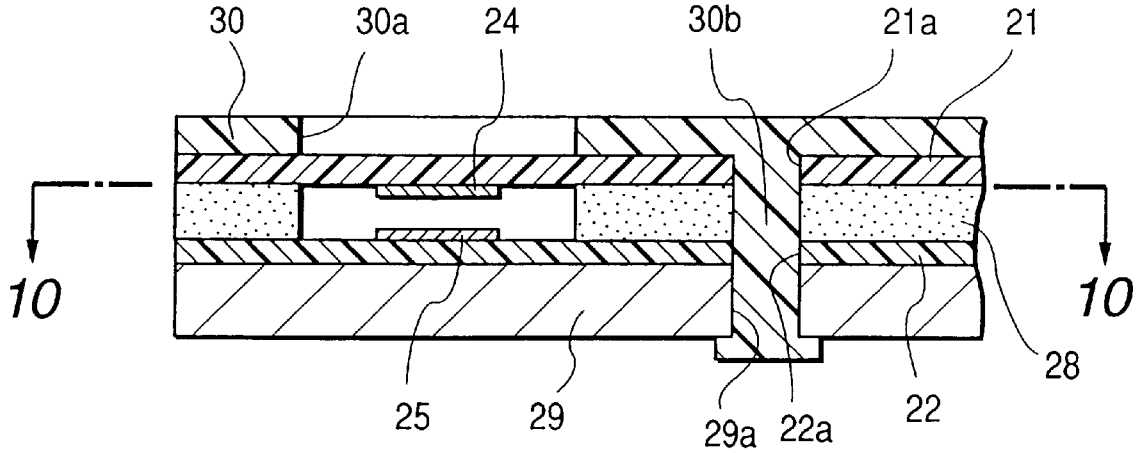
FIG. 9 PRIOR ART
FIG. 9 is an enlarged sectional view of a principal portion of a conventional membrane switch.
Figure 10:
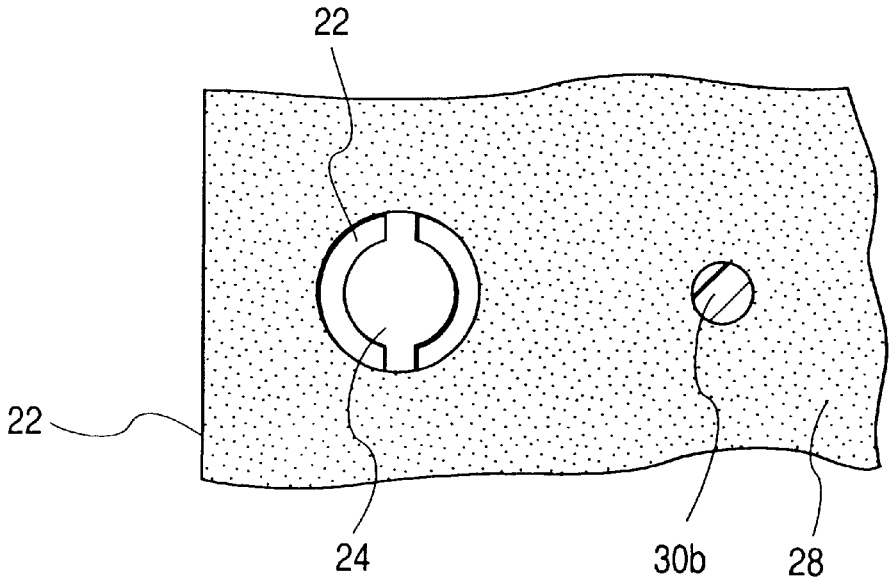
FIG. 10 PRIOR ART
FIG. 10 is a sectional view taken on line 10—10 in FIG. 9.
Figure 11:
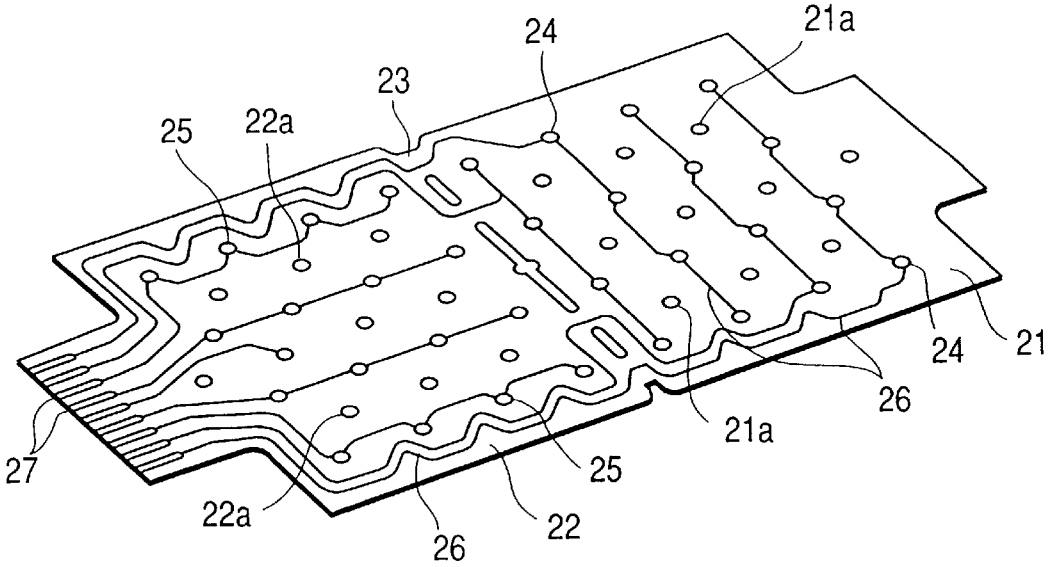
FIG. 11 PRIOR ART
FIG. 11 is a perspective view of an upper sheet and a lower sheet both used in the conventional membrane switch.
Figure 12:
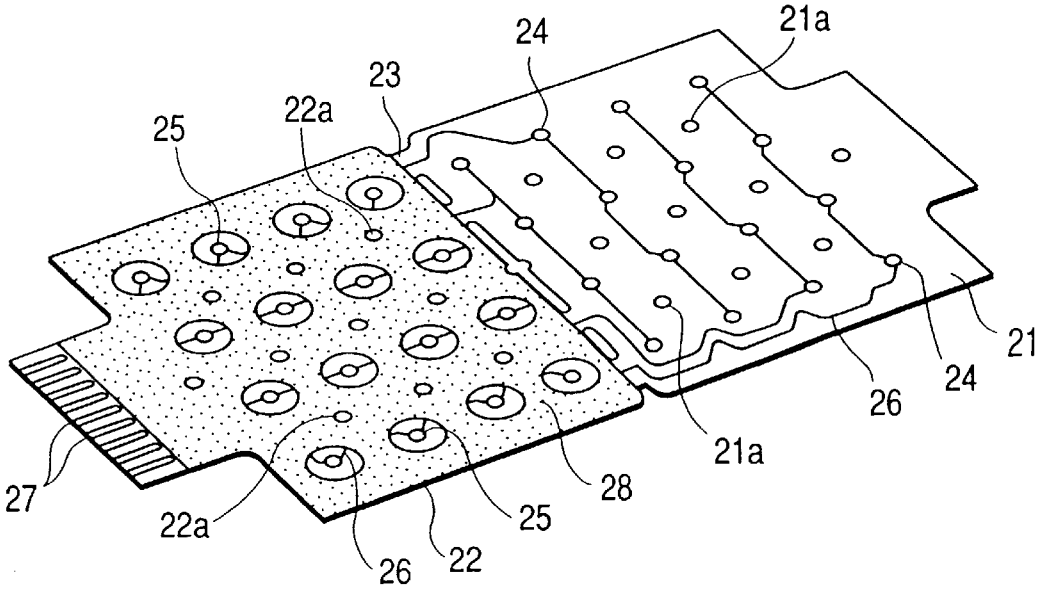
FIG. 12 PRIOR ART
FIG. 12 is a perspective view of the conventional membrane switch, with an insulating resist layer formed on the lower sheet.
Figure 13:
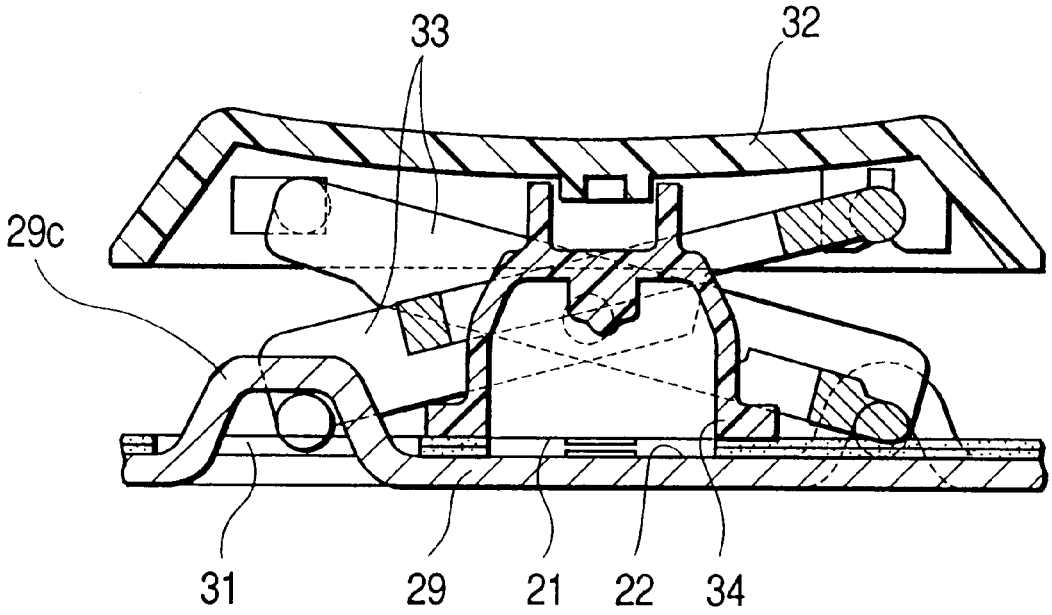
FIG. 13 PRIOR ART
FIG. 13 is a sectional view of a principal portion of a conventional membrane switch.

Referring now to FIG. 8, there is illustrated a membrane switch according to the fifth mode of embodiment of the present invention, in which, instead of the second insulating resist layer 9 formed so as to surround the whole circumference of each mounting hole 2*a* and the second insulating resist layer 9 formed on the peripheral edge portion both described in the first mode of embodiment, a second insulating resist layer 9 is formed on the first insulating resist layer 8 at each of positions near contact portions 5 so as to surround the whole circumference of each contact portion 5, thereby ensuring bonding throughout the whole circumference of each contact portion 5.

Although the first and second insulating resist layers 8 and 9 are here formed on the lower sheet 2, both layers may be formed on the upper sheet 1.

Thus, the feature of the present invention resides in forming the insulating resist layers thicker at portions where the bonding around mounting holes must be ensured, than at the other portion. The second insulating resist layer 9 provided for such thickening purpose may be formed on any of the upper sheet 1 side and the lower sheet 2 side.

In the membrane switch of the present invention, as set forth above, the second insulating resist layer 9 is formed on the first insulating resist layer 8 at each of positions near the mounting holes 2*a* so as to surround the whole circumference of each mounting hole 2*a*, thus forming two layers, so that with a lower pressing force than in the prior art it is possible to ensure bonding throughout the whole circumferences of mounting holes 1*a* and 2*a*.

Since the bonding can thus be ensured throughout the whole circumferences of mounting holes 1*a* and 2*a*, water does not soak into the contact portions 4 and 5 through the mounting holes 1*a* and 2*a*, thus ensuring switch-over of contacts.

Besides, by forming the second insulating resist layer on the first insulating resist layer along the peripheral edge portion of the lower sheet 2, it is possible to ensure bonding of the peripheral edge portions of both upper and lower sheets and water does not soak into the contact portions 4 and 5 through the peripheral edge portions, whereby the switch-over of contacts can be extremely ensured.

Moreover, by forming the second insulating resist layer 9 on the first insulating resist layer 8 at each of positions near the contact portions 5, the bonding is ensured in the vicinity of the contact portions 4 of the upper sheet 1, whereby it is possible to prevent floating of the upper sheet 1 and ensure the switch operation.

Further, by forming the second insulating resist layer 9 on the first insulating resist layer 8 at each of positions near the contact portions 5 so as to surround the contact portions 5, it is possible to ensure bonding around the contact portions and hence possible to prevent floating of the upper sheet and ensure the switch operation.

What is claimed is:

1. A membrane switch device comprising:

an insulating upper sheet;

an insulating lower sheet disposed in an opposed relation to said upper sheet;

a plurality of contact portions formed on each of said upper and lower sheets in such a manner that the contact portions formed on the upper sheet and the contact portions formed on the lower sheet come to be opposed to each other; and a plurality of mounting holes formed in each of said upper and lower sheets in such a manner that the mounting holes formed in the upper sheet and the mounting holes formed in the lower sheet come to be opposed to each other, wherein a first insulating resist layer is formed on at least one of said upper and lower sheets except the portions where said contact portions are positioned, a second insulating resist layer is formed on said first insulating resist layer at positions near said mounting holes so as to surround the whole circumference of each of said mounting holes, and said upper and lower sheets are pasted together by said first and second insulating resist layers.

2. A membrane switch device according to claim 1, wherein said second insulating resist layer is formed on said first insulating resist layer positioned along the peripheral edge of either said upper sheet or said lower sheet, and the peripheral edge portions of the upper and lower sheets are pasted together by said second insulating resist layer.

3. A membrane switch device according to claim 2, wherein said second insulating resist layer is formed on said first insulating resist layer at positions near said contact portions, and said upper and lower sheets are pasted together in the vicinity of the contact portions by the second insulating resist layer.

4. A membrane switch device comprising:

an insulating upper sheet;

an insulating lower sheet disposed in an opposed relation to said upper sheet; and a plurality of contact portions formed on each of said upper and lower sheets in such a manner that the contact portions formed on the upper sheet and the contact portions formed on the lower sheet come to be opposed to each other, wherein a first insulating resist layer is formed on at least one of said upper and lower sheets except the portions where said contact portions are positioned, a second insulating resist layer is formed on said first insulating resist layer at positions near said contact portions so as to surround each of the contact portions, and said upper and lower sheets are pasted together by said first and second insulating resist layers.

* * * * *